US009729963B2

(12) United States Patent
Cagdaser et al.

(10) Patent No.: US 9,729,963 B2
(45) Date of Patent: Aug. 8, 2017

(54) MULTI-FUNCTION PINS FOR A PROGRAMMABLE ACOUSTIC SENSOR

(71) Applicant: InvenSense, Inc., San Jose, CA (US)

(72) Inventors: Baris Cagdaser, Sunnyvale, CA (US); Omid Oliaei, Los Altos, CA (US); Behrad Aria, Alameda, CA (US)

(73) Assignee: INVENSENSE, INC., San Jose, CA (US)

( * ) Notice: Subject to any disclaimer, the term of this patent is extended or adjusted under 35 U.S.C. 154(b) by 182 days.

(21) Appl. No.: 14/074,587

(22) Filed: Nov. 7, 2013

(65) Prior Publication Data

US 2015/0125004 A1 May 7, 2015

(51) Int. Cl.
*H04R 3/00* (2006.01)
*H04R 1/08* (2006.01)
*H04R 19/00* (2006.01)

(52) U.S. Cl.
CPC ..... *H04R 3/00* (2013.01); *H04R 1/08* (2013.01); *H04R 19/005* (2013.01); *H04R 2201/003* (2013.01)

(58) Field of Classification Search
CPC ..... H04R 3/00; H04R 1/08; H04R 2420/05; H04R 19/005; H04R 1/1041; H04R 2201/003; H04R 2225/33; H04R 2225/49; H04R 2225/55; H04R 2420/00; H04R 25/30; H04R 25/554; H04R 5/04; G10K 9/12; H04M 1/0274; H04M 19/048; H04M 1/0254; H04M 1/573; H04M 1/64; H04M 1/72527; H04M 1/73; H04M 3/02; H04Q 9/00; H04N 5/3575; H04N 5/3698; H04N 5/3742; H04N 5/3745; H04N 5/378
USPC ..... 381/111, 112, 113, 92
See application file for complete search history.

(56) References Cited

U.S. PATENT DOCUMENTS 6,853,733 B1 2/2005 Groothedde et al.
8,170,237 B2 * 5/2012 Shajaan ..... H04R 1/005 381/111
8,290,186 B2 * 10/2012 Jung ..... G11B 19/02 381/309

(Continued)

FOREIGN PATENT DOCUMENTS

EP 1359787 A2 11/2003
EP 1906704 4/2008

(Continued)

OTHER PUBLICATIONS

Jebreel Mohamed Muftah Salem, "A Reliable CMOS Receiver for Power Line Communications in Integrated Circuits", Dec. 11, 2012.

(Continued)

*Primary Examiner* — Lun-See Lao
(74) *Attorney, Agent, or Firm* — Amin, Turocy & Watson, LLP

(57) ABSTRACT

A programmable acoustic sensor is disclosed. The programmable acoustic sensor includes a MEMS transducer and a programmable circuitry coupled to the MEMS transducer. The programmable circuitry includes a power pin and a ground pin. The programmable acoustic sensor also includes a communication channel enabling data exchange between the programmable circuitry and a host system. One of the power pin and the ground pin can be utilized for data exchange.

26 Claims, 7 Drawing Sheets

(56) References Cited

U.S. PATENT DOCUMENTS

| | | | | |
|---|---|---|---|---|
| 8,478,912 | B2 | 7/2013 | Liu et al. | |
| 8,831,246 | B2 | 9/2014 | Josefsson | |
| 9,084,070 | B2 | 7/2015 | Crockett et al. | |
| 9,161,112 | B2 * | 10/2015 | Ye | H04R 1/08 |
| 2004/0122541 | A1 * | 6/2004 | DiSanza | H04R 29/004 700/94 |
| 2004/0156520 | A1 * | 8/2004 | Poulsen | H04M 1/6008 381/369 |
| 2005/0169483 | A1 * | 8/2005 | Malvar | H04R 3/005 381/58 |
| 2008/0153537 | A1 | 6/2008 | Khawand et al. | |
| 2008/0167868 | A1 | 7/2008 | Kanevsky et al. | |
| 2010/0113088 | A1 * | 5/2010 | Erceg | H04W 72/1215 455/552.1 |
| 2010/0254544 | A1 | 10/2010 | Kimura et al. | |
| 2011/0142261 | A1 | 6/2011 | Josefsson | |
| 2011/0200215 | A1 | 8/2011 | Apfel et al. | |
| 2012/0114134 | A1 | 5/2012 | Li et al. | |
| 2012/0300960 | A1 | 11/2012 | Mackay et al. | |
| 2013/0058495 | A1 | 3/2013 | Furst et al. | |
| 2013/0108088 | A1 * | 5/2013 | Jensen | H04R 25/505 381/312 |
| 2013/0163781 | A1 | 6/2013 | Thyssen et al. | |
| 2013/0182876 | A1 | 7/2013 | Mulder et al. | |
| 2013/0195288 | A1 | 8/2013 | Ye | |
| 2014/0321664 | A1 | 10/2014 | Huang et al. | |
| 2014/0348331 | A1 | 11/2014 | Gran et al. | |
| 2015/0124984 | A1 | 5/2015 | Han et al. | |
| 2016/0125876 | A1 | 5/2016 | Schroeter et al. | |

FOREIGN PATENT DOCUMENTS

| | | |
|---|---|---|
| JP | 2013-521687 | 6/2013 |
| WO | WO 2007/009465 | 1/2007 |

OTHER PUBLICATIONS

Vipul Chawla, et al., "Dual Use of Power Lines for Data Communications in Microprocessors," 2011, IEEE.

International Search Report and Written Opinion dated Mar. 15, 2016 for PCT Application Serial No. PCT/US2015/067413, 13 pages.

European Office Action dated Feb. 4, 2016 for European Serial No. 14 191 773.2, 6 pages.

Office Action dated Apr. 28, 2016 for U.S. Appl. No. 14/975,155, 35 pages.

Extended European Search Report dated Mar. 31, 2015 for European Application Serial No. EP20140191773, 8 pages.

Korean Office Action dated Nov. 2, 2015 for Korean Application Serial No. 10-2014-0153844, 4 pages.

Korean Office Action dated Jun. 16, 2016 for Korean Application Serial No. 10-2014-0153844, 3 pages (English translation).

Korean Office Action dated Sep. 27, 2016 for Korean Application Serial No. 10-2014-0153844, 5 pages (including English translation).

Office Action dated Sep. 28, 2016 for U.S. Appl. No. 14/975,155, 49 pages.

International Search Report and Written Opinion for PCT Application Serial No. PCT/US2016/047346 dated Nov. 14, 2016, 11 pages.

Office Action dated May 3, 2017 for U.S. Appl. No. 14/951,749, 39 pages.

* cited by examiner

100

150

500

600

MULTI-FUNCTION PINS FOR A PROGRAMMABLE ACOUSTIC SENSOR

FIELD OF THE INVENTION

The present invention is directed generally to acoustic sensors and more particularly to providing for a programmable acoustic sensor.

BACKGROUND

Programmable acoustic sensors are a class of MEMS devices that includes microphones. Conventional programmable acoustic sensors typically can include for example a MEMS transducer that is in contact with acoustic pressure. Acoustic pressure variations may cause one or more electrical parameters of the MEMS transducer to change. The MEMS transducer can be formed from for example but not limited to, a diaphragm or a suspended plate. Increasing acoustic pressure causes a diaphragm to bend or a translational displacement of a suspended plate.

A programmable acoustic sensor is utilized to sense a change in the electrical parameters of the MEMS transducer and produces an electrical output signal that is a measure of the acoustic pressure. The electrical parameters sensed by the programmable acoustic sensor can be of many forms, including but not limited to, a capacitance change determined by a bending of a diaphragm or displacement of a suspended plate.

A response of the MEMS transducer to an acoustic pressure change is typically a function of the mechanical parameters of the MEMS transducer. The programmable acoustic sensor also has its own variations, which in general are substantially smaller than the mechanical ones of the MEMS transducer. Therefore, an input signal provided from the MEMS transducer to the programmable acoustic sensor that varies widely in voltage can result in sub-optimal performance of the acoustic sensor. Hence to minimize yield loss in manufacturing due to large variations in the mechanical parameters of the MEMS transducer, it is desirable that the acoustic sensor be programmable.

Programmability can also be used to enhance testability and observability of the programmable acoustic device, which can further improve the test accuracy and reduce the test cost. Programmability may be used to compensate for variations in key sensor parameters, for example but not limited to, transducer sensitivity, signal to noise ratio (SNR), resonance frequency of the mechanical element of the transducer, and a phase delay of the acoustic sensor.

What is needed whether in a digital or analog sensor is a system and method for increasing the functionality of the sensor without increasing the number of pins utilized on the sensors. The system and method should be simple, cost effective and adaptable to existing environments. The present invention addresses such a need.

SUMMARY

Embodiments of a programmable acoustic sensor are disclosed. In a first aspect, a programmable acoustic sensor is disclosed. The programmable acoustic sensor includes a MEMS transducer and a programmable circuitry coupled to the MEMS transducer. The programmable circuitry includes a power pin and a ground pin. The programmable acoustic sensor also includes a communication channel enabling data exchange between the programmable circuitry and a host system. One of the power pin and the ground pin can be utilized for data exchange.

In a second aspect, the programmable acoustic sensor includes a MEMS transducer and a programmable circuitry coupled to the MEMS transducer. In the second aspect, the programmable acoustic sensor includes only three pins. The programmable acoustic sensor also includes a communication channel enabling data exchange between the programmable acoustic sensor and a host system. At least one of the only three pins can be utilized for data exchange.

In a third aspect, the programmable acoustic sensor includes a MEMS transducer and a programmable circuitry coupled to the MEMS transducer. The programmable acoustic sensor includes only four pins. The programmable acoustic sensor also includes a communication channel enabling data exchange between the programmable circuitry and a host system. At least one of the only four pins can be utilized for data exchange.

DETAILED DESCRIPTION

Figure 1:
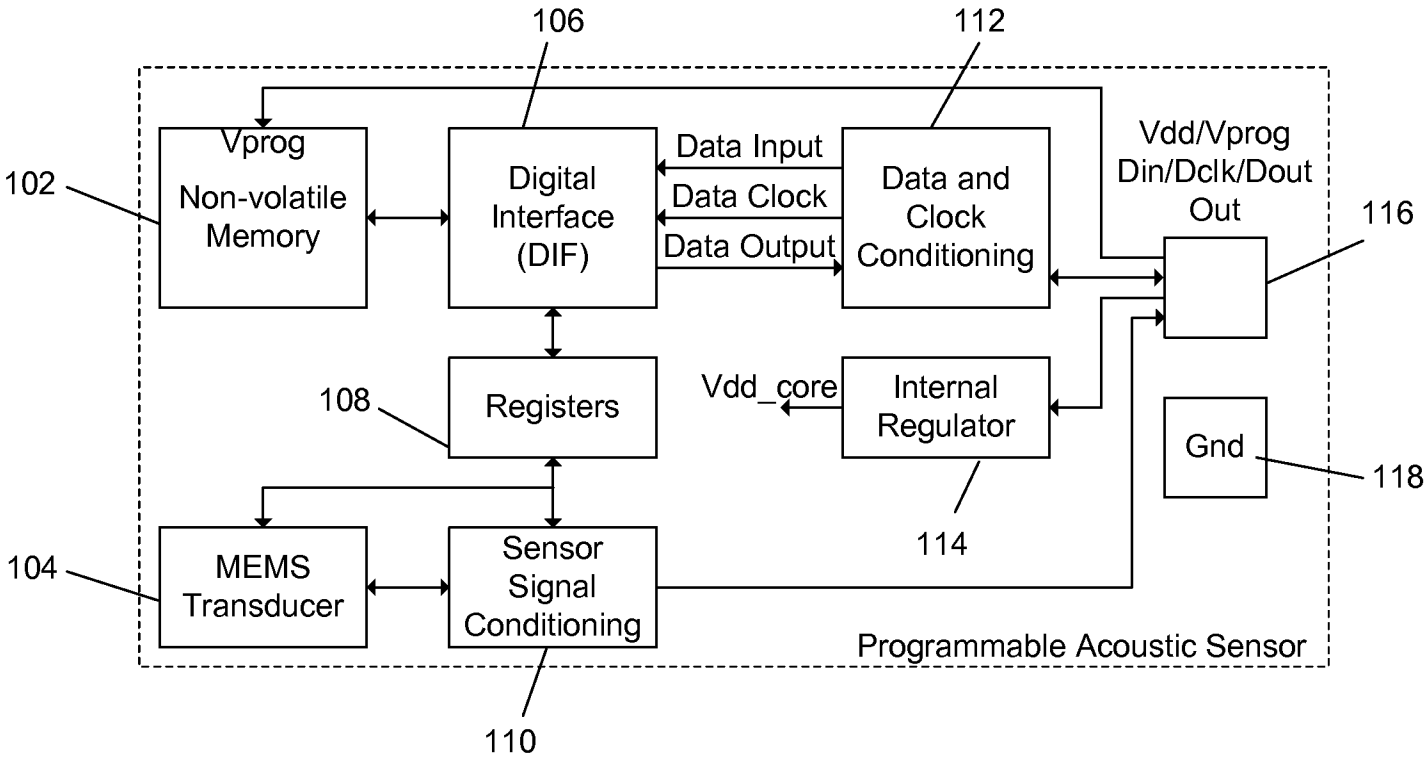
FIG. 1 is a block diagram of a programmable acoustic sensor which includes only a power pin and a ground pin.

The present invention is directed generally to acoustic sensors and more particularly to providing for a programmable acoustic sensor interface. The following description is presented to enable one of ordinary skill in the art to make and use the invention and is provided in the context of a patent application and its requirements. Various modifications to the preferred embodiments and the generic principles and features described herein will be readily apparent to those skilled in the art. Thus, the present invention is not intended to be limited to the embodiments shown, but is to be accorded the widest scope consistent with the principles and features described herein.

In the described embodiments Micro-Electro-Mechanical Systems (MEMS) refers to a class of structures or devices fabricated using semiconductor-like processes and exhibiting mechanical characteristics such as the ability to move or deform. MEMS devices often, but not always, interact with electrical signals. MEMS devices include but are not limited to gyroscopes, accelerometers, magnetometers, pressure sensors, microphones, and radio-frequency components. Silicon wafers containing MEMS structures are referred to as MEMS wafers. The MEMS acoustic sensor includes a MEMS transducer and an electrical interface.

In an embodiment, the MEMS transducer and the electrical interface can be fully integrated as single die, or in another embodiment a MEMS transducer and the electrical interface can be two separate dies, where the MEMS transducer and the electrical interface are inter-connected via additional pins and bond wires. In either case, the programmable acoustic sensor is coupled to a host system via electrical interface pins. In embodiments, the host system can be a tester used during production and characterization, an end application that acquires the acoustic sensor output or the like.

In an embodiment, an analog output acoustic sensor includes a programmable acoustic sensor that includes three pins. In such a system, the three pins are: a power (Vdd) pin, a ground (Gnd) pin and an output (Out) pin. The Vdd and Gnd pins are coupled to the programmable acoustic sensor. The Out pin which is an acoustic sensor output provides an analog output to the host system.

In another embodiment, a digital output acoustic sensor may have five pins. In such a system, the five pins are: a power (Vdd) pin, a ground (Gnd) pin, clock (Clk) pin, left/right (L/F) selection and a digital output (Out) pin. The Vdd, Gnd, Clk and L/F pins are coupled to the programmable acoustic sensor.

In the embodiment the digital output (Out) provides an acoustic sensor output to the host system. For example the digital output comprises provides a pulse density modulated (PDM) acoustic sensor output or the like.

In order to enable programmability without increasing the number of pins in the programmable acoustic sensor, secondary functions are added to the existing pins. These secondary functions include but are not limited to, detecting a valid communication request, acknowledging the request, receiving data from the host system, sending data to the host system. To describe the features of the present invention in more detail refer now to the following description in conjunction with the accompanying drawings.

FIG. 1 is a block diagram of a programmable acoustic sensor 100 which includes only two pins. The programmable acoustic sensor 100 includes pins 116 and 118. In an embodiment, the pin 116 is the power pin (Vdd) and the pin 118 is the ground pin. The pin 116 is coupled to a non-volatile memory (NVM) 102, which stores data. The NVM 102 is coupled to a digital interface (DIF) 106.

The DIF 106 receives data input and data clock signal and provides data output signals to and from a data and clock conditioning circuit 112. The data and clock conditioning circuit 112 is coupled in a bi-directional manner to the power pin 116. An internal regulator 114 is also coupled to the power pin 116. The DIF 106 is also coupled to one or more registers 108. The one or more registers 108 are coupled to a MEMS transducer 104 and a sensor signal conditioning circuit 110. The sensor signal conditioning circuit 110 in turn is coupled to the power pin 116. In this embodiment the programmable acoustic sensor 100 needs only power pin 116 and the ground pin 118. The power pin 116 also serves as digital input, digital clock, digital output, and the main sensor output. In such a system, the data and clock conditioning circuit 112 can for example translate the data encoded onto the power supply pin 116 into a standard logic level signal that can be fed into the digital interface. The programmable acoustic sensor 100 can therefore receive data and instructions from outside based on the communication channel protocol for any of identifying, programming, reconfiguring, and compensating the programmable acoustic sensor. The programmable acoustic sensor can communicate with a host system from any of test equipment, another sensor, digital signal processor, application processor, sensor hub, coder-decode (codec), or the like. The host system may also be capable of dynamically programming, reconfiguring, and compensating the programmable acoustic sensor.

Figure 2:
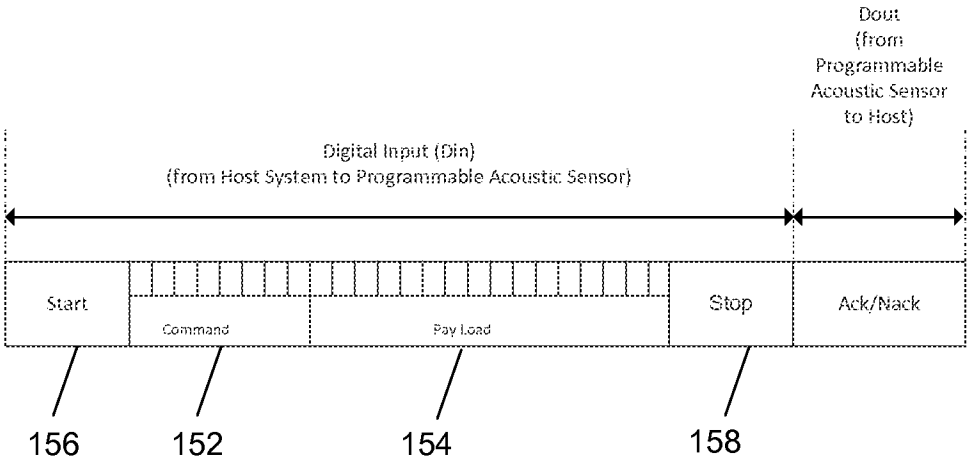
FIG. 2 is a diagram of a programmable acoustic sensor communication channel protocol.

FIG. 2 is a diagram of a programmable acoustic sensor communication channel protocol 150. Referring to FIGS. 1 and 2 together, the communication channel 150 operates in DIF 106 of FIG. 1. The DIF 106 receives a command 152 and a payload 154 from a host system, (for example but not limited to a write command, a register address, and trim data) through the pin 116. The payload 154 received through the pin 116 is stored in one or more registers 108 if necessary. Some of the one or more registers 108 may be used to control different functions such as for example, trim and test functions built into the sensor signal conditioning circuit 110, which processes an output from the MEMS transducer 104 and produces the acoustic sensor output. In an embodiment, DIF 106 may also be capable of initializing the one or more registers 108 at power-on by loading the data stored in the NVM 104.

As is seen, in this embodiment pin 116 can operate as a data input and/or data output and/or data clock in a variety of ways. The functions of pin 116 operating as data input, data output or data clock can co-exist with the primary function of the pin 116 which may be for example but not limited to providing power (Vdd).

Data coming through the communication channel 150 can be transmitted synchronously, where a data clock determines when data bits start and stop. In an embodiment, data transmission can also happen asynchronously, where there is no need for a data clock. In asynchronous communication channels, a beginning and an end of data are marked by other means, for example but not limited to, special beginning and an end bit patterns or a non-return-to-zero pattern where each bit starts with a rising edge.

The programmable acoustic sensor 100 can therefore receive data and instructions from other devices based on the communication channel protocol for any of identifying, programming, reconfiguring, and compensating the programmable acoustic sensor. The above functions include but are not limited to enabling or disabling features such as digital output, calibration, and determining a degree of compensation of programmable acoustic sensor. The determining a degree of compensation includes but is not limited to phase matching and gain trimming. The communication channel protocol 150 can be utilized for test features such as obtaining and identifying electrical self-test data. Self-test may include enabling a circuit that applies an electrostatic force causing the acoustic sensor to produce a known output signal. It is possible to determine that the acoustic sensor is functional by examining the level of the output signal. The communication channel protocol includes provisions to avoid false communication, a wake-up detector which continuously monitors communication requests during normal operation to allow an end user to initiate and establish communication following a certain protocol. If communication request does not follow the protocol the wake-up detector considers communication request as a false communication and ignores the request.

The communication protocol may include for example a wake-up detector which continuously monitors communication requests during normal operation. This will allow an end user to initiate and establish communication with the programmable acoustic sensor. Accordingly a wake up detector can be utilized to turn off the digital interface 106 or the digital interface 106 can turn off as a default mode of operation to save power.

Both a data input and data clock can be for example be super-imposed on the main signal that the pin 116 is carrying through a high frequency carrier with a significantly smaller amplitude. In one embodiment, the data input signal is encoded into either an amplitude (amplitude shift keying, ASK) or a frequency (frequency shift keying, FSK) of the high frequency carrier.

To provide the required digital data signaling for the DIF, the signals must be conditioned Hence the data and clock conditioning circuit 112 is utilized for to prepare the signals for the different modes of the pin. To describe some embodiments of such circuits and there operation refer now to the following description in conjunction with the accompanying Figures. The below described embodiments are exemplary and one of ordinary skill in the art recognizes there may be many and various modifications and they would be within the spirit and scope of the present invention.

Figure 3:
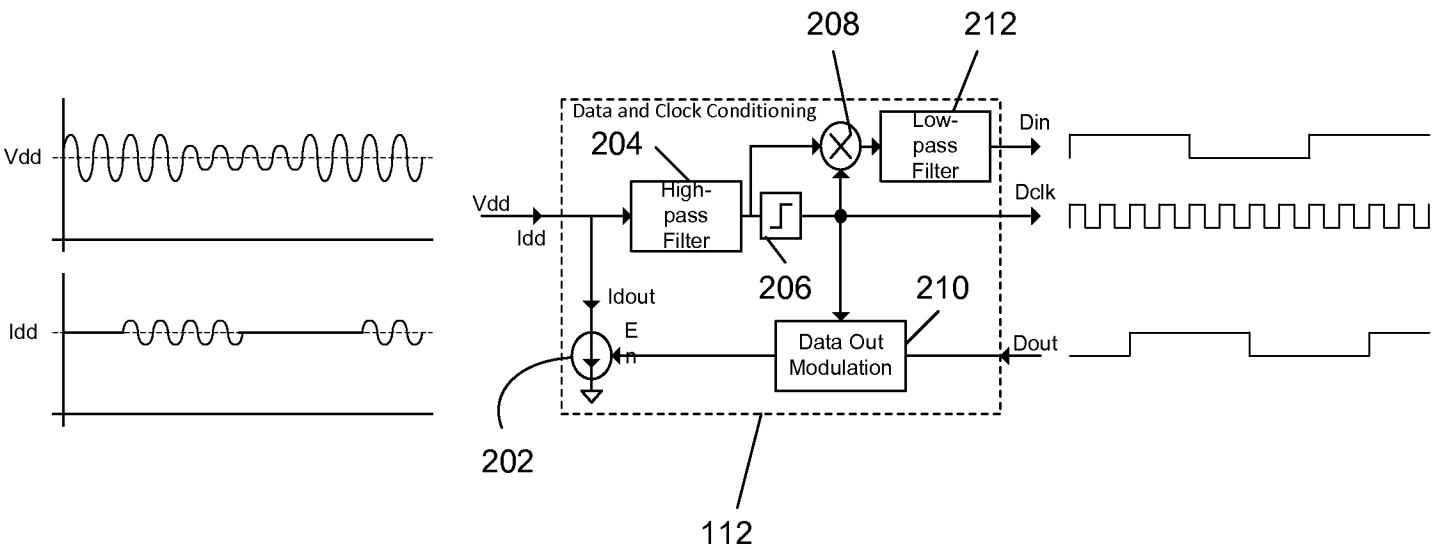
FIG. 3 is a block diagram of a first embodiment of a data and clock conditioning circuit with high frequency carrier and amplitude shift key signaling scheme superimposed on power.

FIG. 3 is a block diagram of a first embodiment of a data and clock conditioning circuit with high frequency carrier and amplitude shift key signaling scheme superimposed on power. In this embodiment, data and clock conditioning circuit 112 comprises a high pass filter 204 which receives power (Vdd). The high pass filter 204 in turn provides an output to a mixer 208 and a comparator 206. The comparator recovers the data clock DCLK. The output of the mixer 208 is appropriately provided to a low pass filter 212 to provide the data in signal. The demodulated signal is utilized to provide the data clock signal, DCLK. The data out signal is provided to the data out modulation block 210 to provide an enable signal to current source 202 to provide current (Idd) output signal.

In an embodiment, amplitude shift keying represents binary data as two distinct signal amplitudes. While the amplitude carries data input, a carrier signal serves as the data clock. Similarly frequency shift keying represents binary data as two distinct frequencies. In case, the clock and data conditioning circuit 112 recovers the data input and the data clock before they are sent to the DIF 106 as conventional digital signals.

Figure 4:
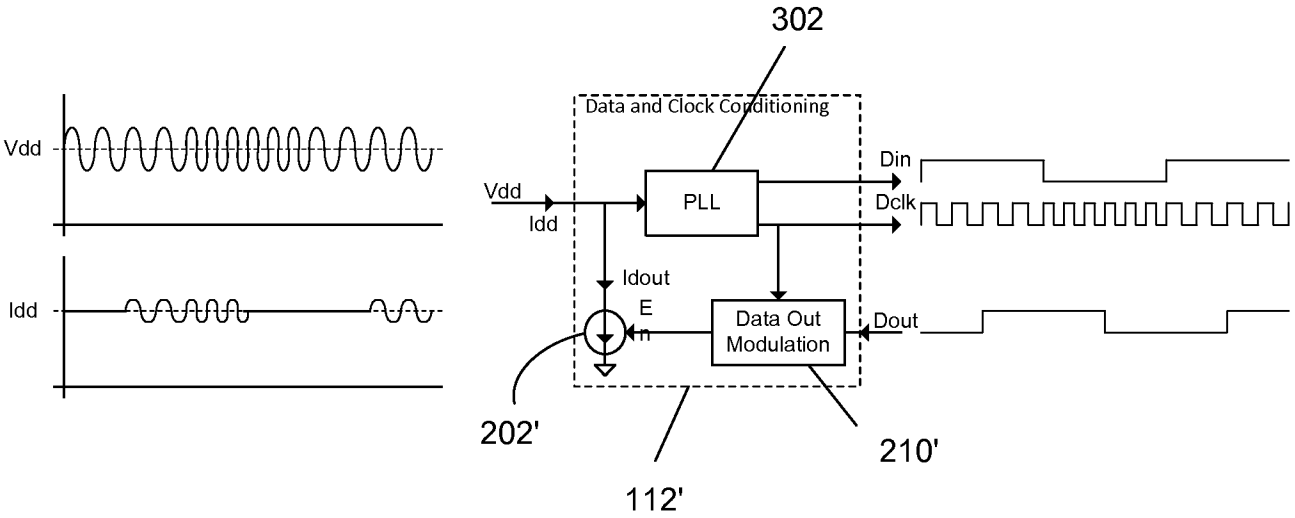
FIG. 4 is a block diagram of a second embodiment of a data and clock conditioning circuit with high frequency carrier and frequency shift key signaling scheme superimposed on power.

FIG. 4 is a block diagram of a second embodiment of a data and clock conditioning circuit 112' with pass-band signaling scheme superimposed on power. In this embodiment, data and clock conditioning circuit 112' comprises a phase locked loop (PLL) 302 which receives power (Vdd). The PLL 302 provides the data input and the data clock. The data output clock and the data out signal is appropriately provided to the data out modulation block 210' to provide an enable signal to current source 202' to provide current (Idd) output signal.

Figure 5:
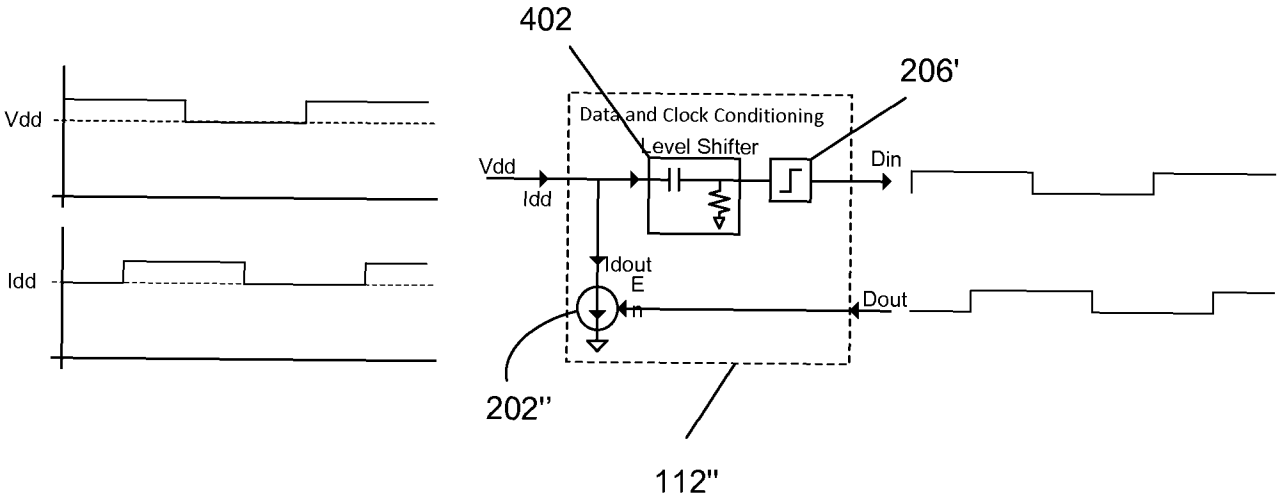
FIG. 5 is a block diagram of a third embodiment of a data and clock conditioning circuit with baseband signaling scheme superimposed on power.

FIG. 5 is a block diagram of a third embodiment of a data and clock conditioning circuit with baseband signaling scheme superimposed on power. In this embodiment, a digital input is superimposed on the main signal of the pin 116 for example but not limited to Vdd, without a high frequency carrier. In this system, data transmission happens asynchronously, and the data and clock conditioning circuit 112' is needed to translate a superimposed digital input to a conventional digital signal levels for the DIF 106.

In this embodiment, data and clock conditioning circuit 112" comprises a level shifter 402 coupled to a comparator circuit 206', which receives power (Vdd and Idd) and provides the data in signal. The data out signal is appropriately provided to current source 202" to provide current (Idd) output signal.

In this embodiment, a data input is translated from the pin 116 through the use the level shifter 402 and the comparator 202". The level shifter circuit 402 can be implemented in a variety of ways, including but not limited to, a high pass filter coupled to Vdd via a capacitor.

It is often necessary to read data back from a programmable acoustic sensor 100. Read back is useful in to verify the content of the NVM 102, as well as the contents of the one or more registers. Whenever a read command is detected, the digital interface 106 may start transmitting data through the digital output. The multifunction pin 116 can be utilized to transmit this data to a host system. In embodiment shown in FIG. 1, the data output information can be transmitted in the form of a load current through the same pin 116. Transmitting this data through the same pin can be achieved by the data and clock conditioning circuit 112 converting data output into current pulses which creates additional loading on the same pin 116, where data input and/or data clock are transmitted as superimposed voltage signals.

Figure 6:
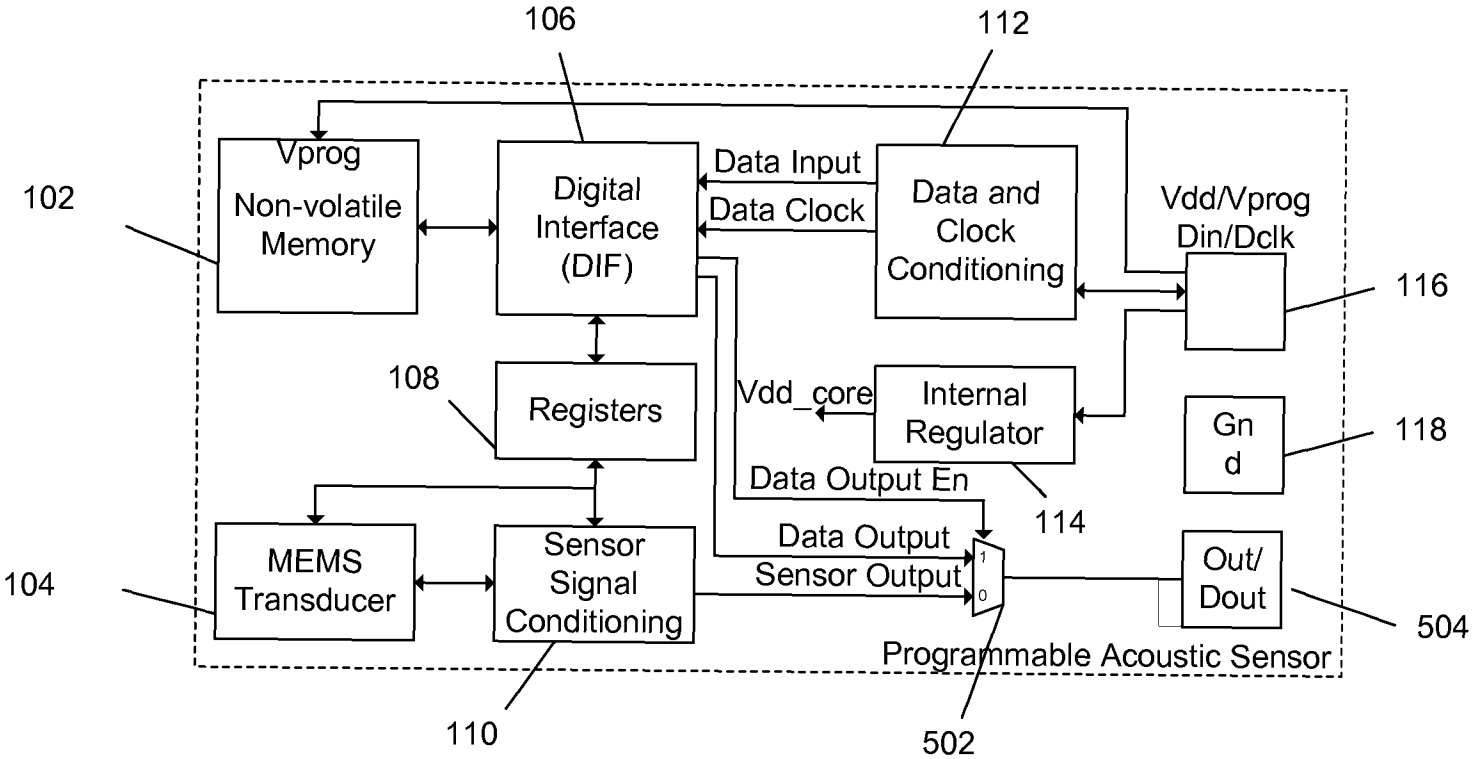
FIG. 6 is a block diagram of a third embodiment of a programmable acoustic sensor with only power, ground, and output pins.

FIG. 6 is a block diagram of a third embodiment of a programmable acoustic sensor 500 with only power, ground, and output pins. FIG. 6 is similar to FIG. 1 but includes an additional pin 504 and associated multiplexer 502. The multiplexer 502 which receives a data output enable signal and a data output signal from the DIF 106 and receives a sensor output signal from the sensor signal conditioning circuit 110. Depending on the conditions it causes the pin 504 to provide a sensor signal or a data output signal. In this embodiment, where sharing the acoustic sensor output is acceptable, the DIF 106 can multiplex pin 504, for example but not limited to the output. This embodiment can be synchronous, where the clock frequency is provided by a carrier. It is also possible to transmit data output asynchronously, for example but not limited to, where the DIF 106 follows a non-return-to-zero pattern with rising edge marking beginning of each bit.

In addition to the communication channel, it is also necessary to program the NVM 102 with the appropriate received trim data so that the data can be recalled during power-on after production trimming. It is often the case that the NVM 102 can require in some embodiments, special power supplies for programming. Generally, programming voltages are higher than the regular supply voltage levels and applied to the NVM for a short amount of time.

In an embodiment, at least one of the existing pins functions as a high voltage programming supply for programming NVM. Providing an internal charge pump circuit requires a significant amount of area in order to support the write requirements of the NVM 102. Programming supply can be provided through one of the existing pins by implementing appropriate switching/voltage regulation scheme. while the rest of the circuitry in the programmable acoustic sensor are protected from high voltage levels during the programming operation. In the embodiments shown in FIG. 1 and FIG. 6, an internal voltage regulator 114 protects the internal circuits of the programmable acoustic sensors 100 and 500 from high voltage levels needed for NVM 102 programming.

Figure 7:
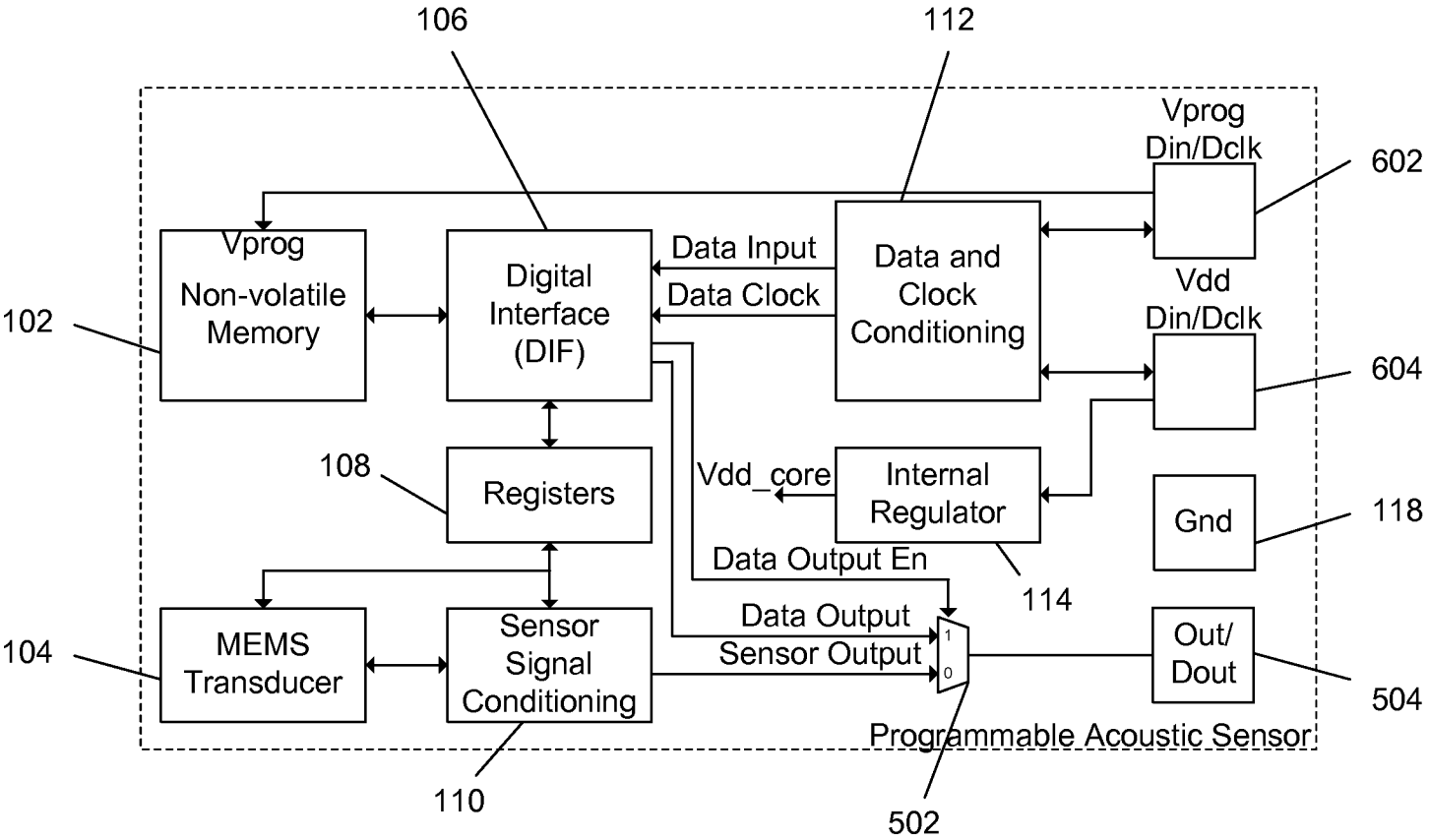
FIG. 7 is a block diagram of a fourth embodiment of a programmable acoustic sensor with power, ground, output, and a non-volatile memory programming supply pins.

FIG. 7 is a block diagram of a fourth embodiment of a programmable acoustic sensor 600 with a power pin 604, a ground pin 118, an output pin 504, and a non-volatile memory programming supply pin 602. FIG. 7 is similar to FIG. 6 except it includes pins 602 and 604. The pin 602 is coupled between the data and clock conditioning circuit 112 and the NVM 102. The pin 604 is coupled between the data and clock conditioning circuit 112 and the internal regulators 114. The pin 604 is utilized for the NVM programming, which can also serve as a digital input, digital clock, and, if necessary, digital output.

Embodiments in accordance with the present invention enable programmability without increasing the number of pins in a programmable acoustic sensor. The enhanced programmability is provided without requiring additional pins to provide secondary functions by utilizing the existing pins for those functions. These secondary functions include but are not limited to, detecting a valid communication request, acknowledging the request, receiving data from the host system, sending data to the host system.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the present invention.

What is claimed is:

1. A programmable acoustic sensor comprising:

a programmable circuitry coupled to a MEMS transducer, wherein the programmable circuitry includes a power pin, a ground pin, and a signal conditioning circuit that processes output data generated by the MEMS transducer; and a communication channel enabling a data exchange between the programmable circuitry and a host system, wherein the power pin is utilized for the data exchange and the power pin receives, from the host system, data generated by the host system.

2. The programmable acoustic sensor of claim 1, wherein the data received from the host system via the power pin is encoded based on amplitude of a voltage associated with the data.

3. The programmable acoustic sensor of claim 1, wherein one of the power pin and the ground pin also functions as data clock.

4. The programmable acoustic sensor of claim 1, wherein one of the power pin and the ground pin also functions as data output.

5. The programmable acoustic sensor of claim 1, wherein one of the power pin and the ground pin functions also as a sensor output.

6. The programmable acoustic sensor of claim 1, wherein one of the power pin and the ground pin also functions as non-volatile memory programming supply.

7. The programmable acoustic sensor of claim 1, wherein an additional pin functions as data input.

8. The programmable acoustic sensor of claim 1, wherein an additional pin functions as data clock.

9. The programmable acoustic sensor of claim 1, wherein an additional pin functions as data output.

10. The programmable acoustic sensor of claim 1, wherein an additional pin functions as non-volatile memory programming supply.

11. The programmable acoustic sensor of claim 1, wherein an additional pin functions as sensor output.

12. The programmable acoustic sensor of claim 1, wherein the programmable acoustic sensor receives, via the power pin, the data from the host system based on a communication protocol for any of identifying, programming, reconfiguring, and compensating the programmable acoustic sensor.

13. The programmable acoustic sensor of claim 12, wherein the reconfiguring of the programmable acoustic sensor comprises enabling or disabling features.

14. The programmable acoustic sensor of claim 13, wherein the features include any of digital output, calibration, degree of compensation of the programmable acoustic sensor, phase matching, and gain trimming.

15. The programmable acoustic sensor of claim 13, wherein the features includes a test feature.

16. The programmable acoustic sensor of claim 15, wherein the test feature includes an electrical self-test.

17. The programmable acoustic sensor of claim 12, wherein the communication protocol includes provisions to avoid false communication.

18. The programmable acoustic sensor of claim 12, wherein the communication protocol uses a high frequency carrier for digital input or digital output.

19. The programmable acoustic sensor of claim 12, wherein the communication protocol directly uses a baseband signals as digital input or digital output.

20. The programmable acoustic sensor of claim 12, wherein the communication protocol includes a wake-up detector which continuously monitors communication requests during normal operation.

21. The programmable acoustic sensor of claim 20, wherein the wake-up detector turns off a digital interface of the programmable acoustic sensor.

22. The programmable acoustic sensor of claim 21, wherein a default mode of operation of the digital interface is turned off to save power.

23. The programmable acoustic sensor of claim 1, wherein the host system includes test equipment, another sensor, a digital signal processor (DSP), an application processor, a sensor hub, or a coder-decoder (codec).

24. The programmable acoustic sensor of claim 1, wherein the host system is capable of dynamically programming, reconfiguring, and compensating the programmable acoustic sensor.

25. A programmable acoustic sensor comprising:

a programmable circuitry that includes a MEMS transducer and three pins, and a signal conditioning circuit that processes output data generated by the MEMS transducer; and a communication channel enabling a data exchange between the programmable acoustic sensor and a host system, wherein a power pin of the three pins is utilized for the data exchange and the power pin receives, from the host system, data generated by the host system.

26. A programmable acoustic sensor comprising:

a programmable circuitry that includes a MEMS transducer and four pins, and a signal conditioning circuit that processes output data generated by the MEMS transducer; and a communication channel enabling a data exchange between the programmable circuitry and a host system, wherein a power pin of the four pins is utilized for the data exchange and the power pin receives, from the host system, data generated by the host system.

* * * * *